US005865233A

United States Patent [19]

Roegner

[11] Patent Number: 5,865,233

[45] Date of Patent: Feb. 2, 1999

[54] PURSE ORGANIZER

[76] Inventor: DeAnna Roegner, 774 Mays Blvd., #10-405, Incline Village, Nev. 89451

[21] Appl. No.: 886,719

[22] Filed: Jul. 1, 1997

[51] Int. Cl.[6] ..... A45C 11/26; A45C 15/04

[52] U.S. Cl. ..... 150/104; 150/106; 150/113; 190/110

[58] Field of Search ..... 190/110, 901; 150/113, 109, 118, 106

[56] References Cited

U.S. PATENT DOCUMENTS

| | | | |
|---|---|---|---|
| 1,705,149 | 3/1929 | Brady | 190/901 X |
| 1,915,007 | 6/1933 | Weiss | 190/901 X |
| 2,038,319 | 4/1936 | Stanley | 190/901 X |
| 2,092,834 | 9/1937 | Doppelt | 190/901 X |
| 2,167,926 | 8/1939 | Glasker | 190/901 X |
| 2,183,428 | 12/1939 | McNary | 150/113 X |
| 2,299,673 | 10/1942 | Zolkind | 190/901 X |
| 2,359,100 | 9/1944 | Florin | 190/901 X |
| 2,413,465 | 12/1946 | Ohlsen | 150/118 X |
| 2,464,312 | 3/1949 | Holden | 150/113 |
| 2,612,199 | 9/1952 | Schocket | 150/111 X |
| 2,899,999 | 8/1959 | Dobbs et al. | 150/113 X |
| 2,937,728 | 5/1960 | Koffler | 190/110 |
| 3,137,374 | 6/1964 | Holtzman | 190/110 |
| 4,161,201 | 7/1979 | Carp | 190/110 |
| 4,386,642 | 6/1983 | Durbin | 190/110 |
| 4,424,841 | 1/1984 | Smith | 190/110 X |
| 4,580,667 | 4/1986 | Herwood | 190/110 |
| 4,852,293 | 8/1989 | Levine et al. | 190/110 X |
| 5,350,045 | 9/1994 | Robertson | 190/110 |

FOREIGN PATENT DOCUMENTS

| | | | |
|---|---|---|---|
| 709828 | 8/1941 | Germany | 150/118 |

*Primary Examiner*—Sue A. Weaver
*Attorney, Agent, or Firm*—Baker & Maxham

[57] ABSTRACT

An organizing case for articles to be carried in a purse, comprises a primary panel of pliable material, the panel being of a generally rectangular configuration having an inner face and outer face and foldable along a selected line transverse of the primary panel forming a front panel and a back panel defining a primary receptacle, the back panel having an inner face, a plurality of straps and loops on the inner face for mounting a plurality of articles, a pocket assembly inside the primary receptacle, the pocket comprising a back pocket panel and a front pocket panel secured together along a bottom inside edges forming a receptacle, and an inner mounting panel pivotally mounted to the primary panel and having a opposite faces, a mirror mounted on one of the faces, and a plurality of attachment devices for detachably mounting a plurality of selected items such as cosmetics upon each of the faces.

20 Claims, 6 Drawing Sheets

PURSE ORGANIZER

BACKGROUND OF THE INVENTION

The present invention relates to article carrying cases and pertains particularly to an improved organizing case having an improved arrangement of multiple pockets and mounting panels for holding multiple personal articles in an organized fashion for carrying in a purse.

Many ladies have many items of makeup which they commonly carry in their purse. These items are often placed loosely in the purse among other articles. This often leaves the items disorganized, sometimes tangled and often difficult to easily locate and retrieve.

There is a need for a purse organizing case that is adaptable to mount or hold many different related or unrelated personal items in an organized fashion. It would be desirable to have a case with multiple holding or mounting panels and pockets for holding many different related articles and unrelated articles for ease of location and retrieval.

SUMMARY OF THE INVENTION

It is the primary object of the present invention to provide an improved purse organizing case with multiple pockets and attachment means for holding articles of different sizes secure and readily accessible in an organized arrangement in a purse.

An organizing case for articles to be carried in a purse, comprises a primary panel of pliable material, said panel being of a generally rectangular configuration having an inner face and an outer face and foldable along a selected line transverse of the primary panel forming a front panel and a back panel defining a primary receptacle, said back panel having an inner face, a plurality of straps and loops on said inner face for mounting a plurality of articles, a pocket assembly inside said primary receptacle, said pocket comprising a back pocket panel and a front pocket panel secured together along a bottom and side edges forming a receptacle, and an inner mounting panel pivotally mounted to said primary panel and having opposite faces, a mirror mounted on one of said faces, and a plurality of attachment means for detachably mounting a plurality of selected items such as cosmetics on each of said faces.

BRIEF DESCRIPTION OF THE PREFERRED EMBODIMENTS

The above and other objects and advantages of the present invention will become apparent from the following description when read in conjunction with the accompanying drawings wherein.

DETAILED DESCRIPTION OF THE PREFERRED EMBODIMENTS

Figure 1:
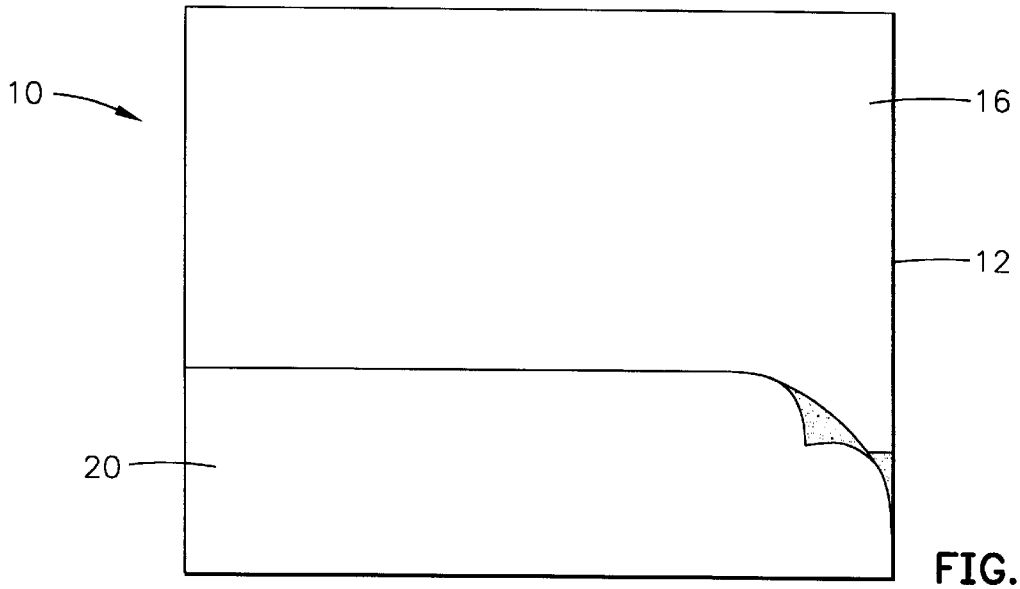
FIG. 1 is a front elevation view of an exemplary preferred embodiment of the invention with the case closed.
Figure 2:
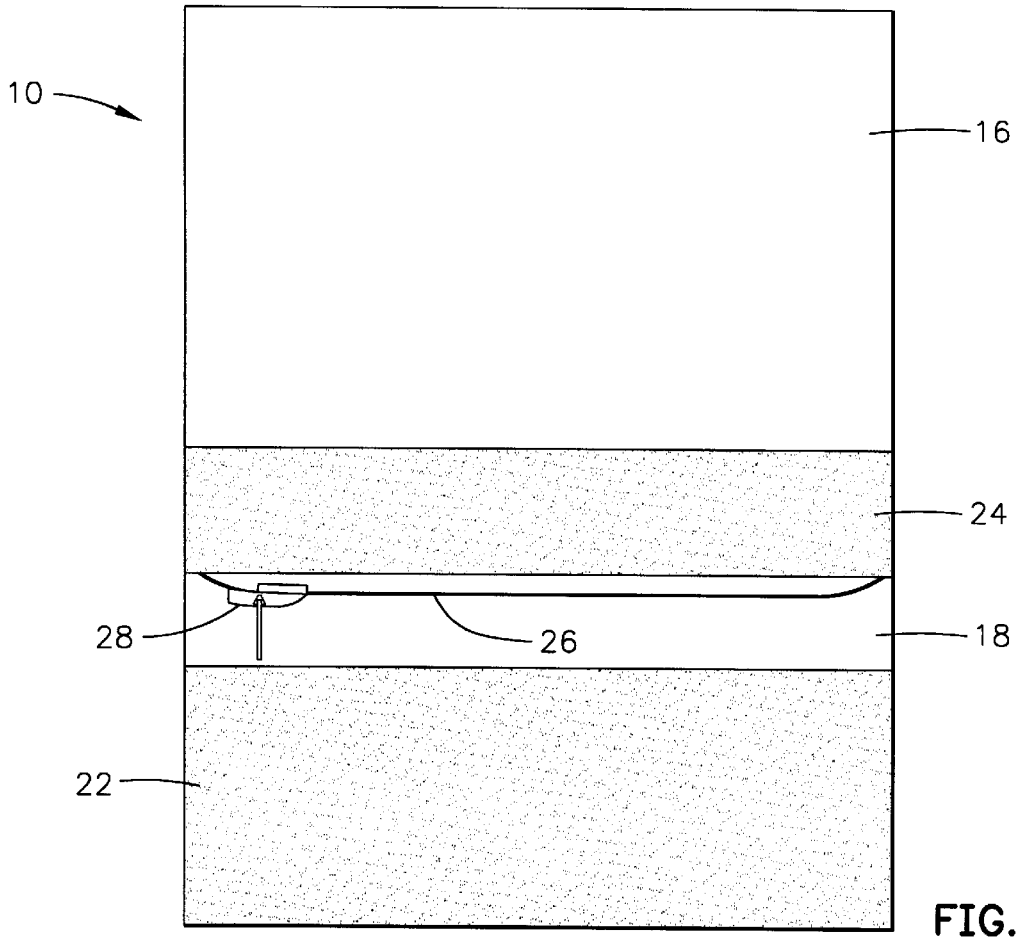
FIG. 2 is a view like FIG. 1 with the case closure flap open.

Referring to FIGS. 1 and 2 of the drawing, the organizing case in accordance with the invention is illustrated and designated generally by the numeral 10. The case is preferably constructed of a pliable material, such as leather, vinyl, or any of the suitable woven materials, now widely used for handbags, purses, suit cases and the like. The case comprises a primary support and closure panel or shell formed of a unitary elongated substantially rectangular panel 12 having inner and outer faces and foldable along a transverse line 14 forming an upper or back panel 16 and lower or front panel 18 defining a primary receptacle.

The primary support panel as shown in the illustrated embodiment comprises an elongated generally rectangular cover panel having an upper end and a lower end with a closure flap 20 having suitable fastening means such as hook and loop fastening means 22 for cooperatively engaging hook and loop fastening means 24 on the upper back of the upper panel 16. The upper or back panel of the primary panel is provided on its outer surface with a outer or back pocket having an opening with closure means such as a zipper 26 having a slider 28. The pocket is formed in the usual manner of opposing rectangular panels secured along three sides like an envelope leaving the opening along one side. One panel of the pocket may include a portion of the primary panel. The pocket is accessible by peeling back closure panel or flap 20 as seen in FIG. 2. The back panel can then be flipped up so that the opening of the outer pocket is at the top for easy access as seen in FIG. 3.

Figure 3:
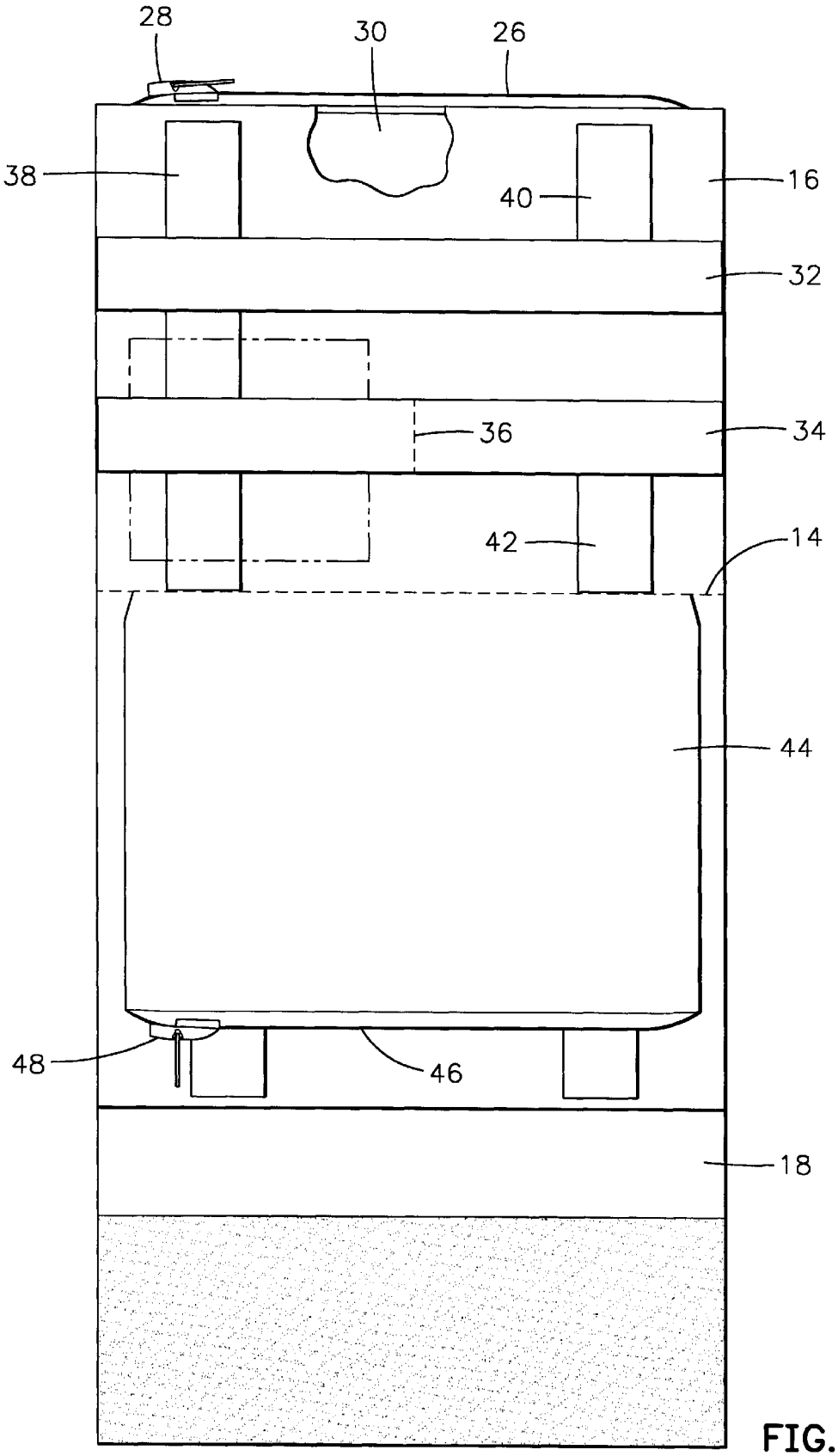
FIG. 3 is a front elevation view of the invention of FIG. 1 with the case shown in its open position.

The upper or back panel 16 of the primary panel is also provided with a stiffener such as a cardboard or the like 30 sandwiched between opposing pliable fabric panels separate from and interior of the back pocket as seen in FIG. 3. The outermost of these panels lies adjacent the inner panel of the pocket and forms a second pocket not having a separate closure. This pocket (not shown) is suitable for receipt and holding of cards and the like.

The upper or back panel is also provided on its inner surface with multiple attachment means for separately detachably attaching a plurality of individual articles. The attachment means in the illustrated embodiment is constructed of a plurality of elastic straps attached to the face of the back panel forming loops. A pair of horizontal elastic straps 32 and 34 are attached at their ends to the back panel, each forming what can be termed a loop for the attachment of articles. The strap 34 is also secured intermediate its ends at 36 to the back panel to form two loops.

Multiple elastic straps 38, 40 and 42 are attached vertically to opposite side edges of the back panel forming multiple loops for detachably attaching articles in place on the face of the back panel. The straps are attached at their ends to the back panel and may also be attached at points in between to form multiple loops. These straps or loops can hold any number and size of articles such as small compacts, tubes of lipstick, and other similar articles.

Referring now to FIG. 3, an inner pocket assembly 44 is illustrated and pivotally secured about on line 14 to the primary panel. The pocket assembly is formed of an envelope-type structure with front and back panels secured along side and bottom edges to form a pocket with an opening at the top. The opening is provided with a suitable closure such as a zipper 46 with slider 48 at the upper edge over the opening to close the pocket. The pocket may be made out of any suitable fabric or other suitable pliable material, as described above.

This organizing case may have any number of the pocket assemblies from 1 or 2 or more, if desired. The case is designed to easily place in a purse for ease of assembling and holding articles or the like, to provide easy access. The pockets are suitable for holding any number and kind of small articles. They may also serve as a coin purse.

Figure 4:
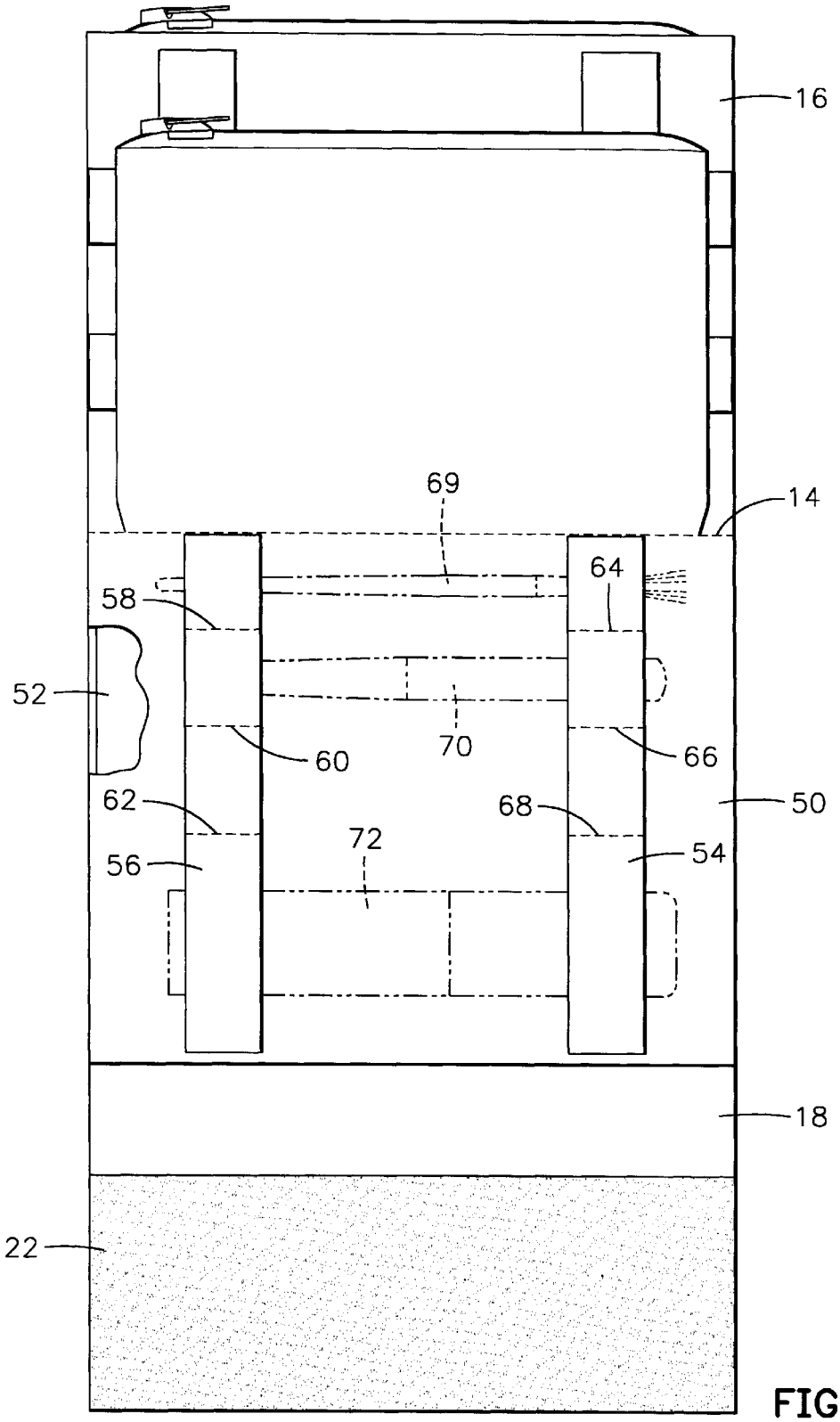
FIG. 4 is a view like FIG. 1 with the case open showing the inside construction with the inside pocket pivoted upward.

Referring to FIG. 4, a mounting panel 50 is provided and mounted for pivoting along line 14. This panel is provided with a suitable interior stiffening panel 52 as in a prior panel for better support. A pair of straps 54 and 56 extend in spaced vertical relation on one or a top face of the panel. These straps are attached at the ends to the panel and are each secured at positions 58 60, 62 and 64, 66, and 68 respectively to the panel to provide multiple loops for securing multiple articles 69, 70, and 72 to the face of the panel.

Figure 5:
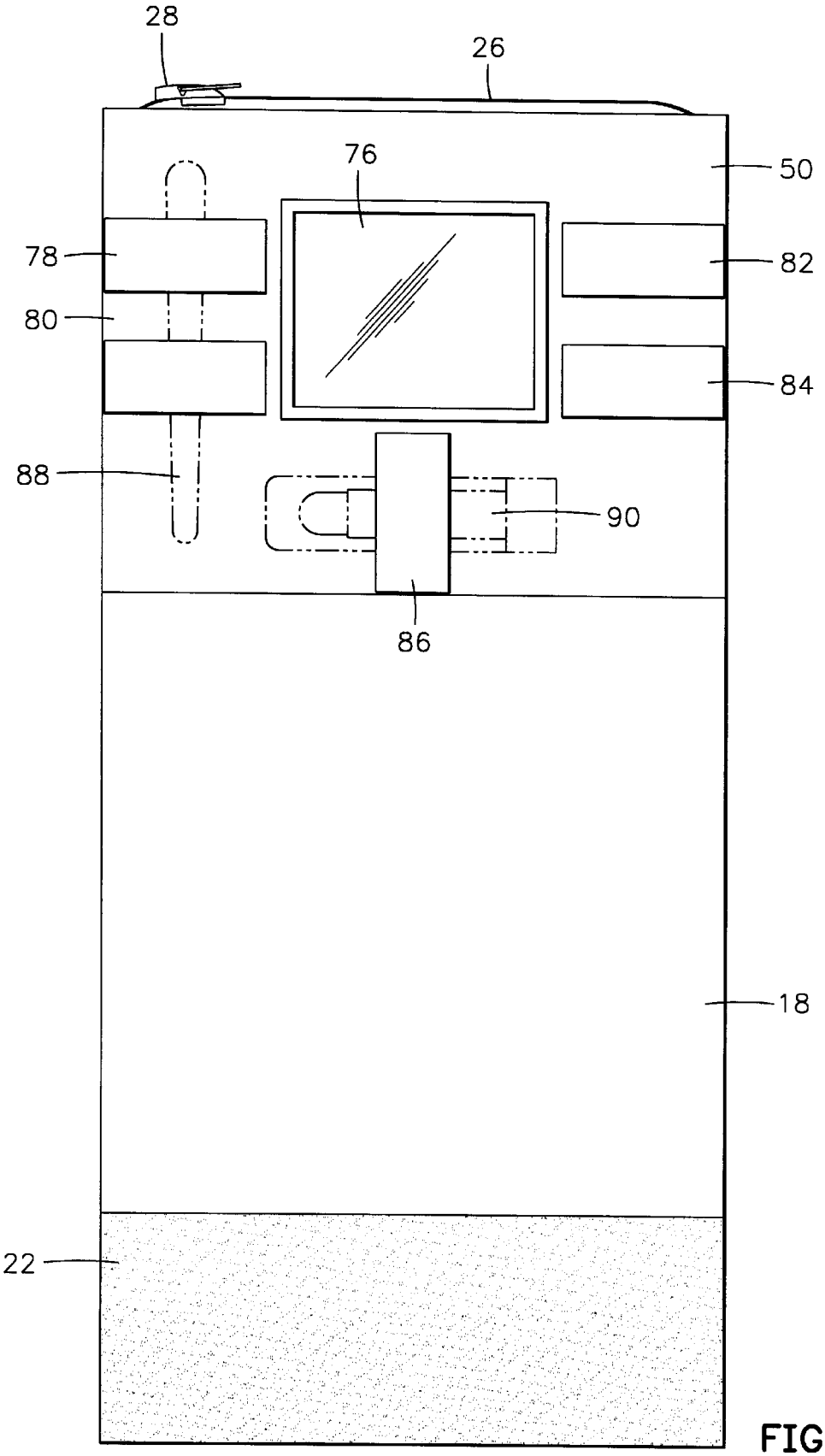
FIG. 5 is a view like FIG. 4 with the internal mounting panel folded upward.

Referring to FIG. 5, the mounting panel 50 is pivoted upward to reveal the opposite side or bottom face. A mirror 76 is mounted in the center of this face of the support panel. A pair of elastic straps 78 and 80 are mounted on one side or the mirror, and a pair of straps 82 and 84 are mounted on the other side. A strap 86 is mounted below the mirror. These may mount any number of different items such as a fingernail file shown in phantom at 88 and a tube of lipstick shown in phantom at 90. Any suitable arrangement of the straps may be made on any of the support panels. The mirror may also be mounted in any suitable position on any of the panels.

Figure 6:
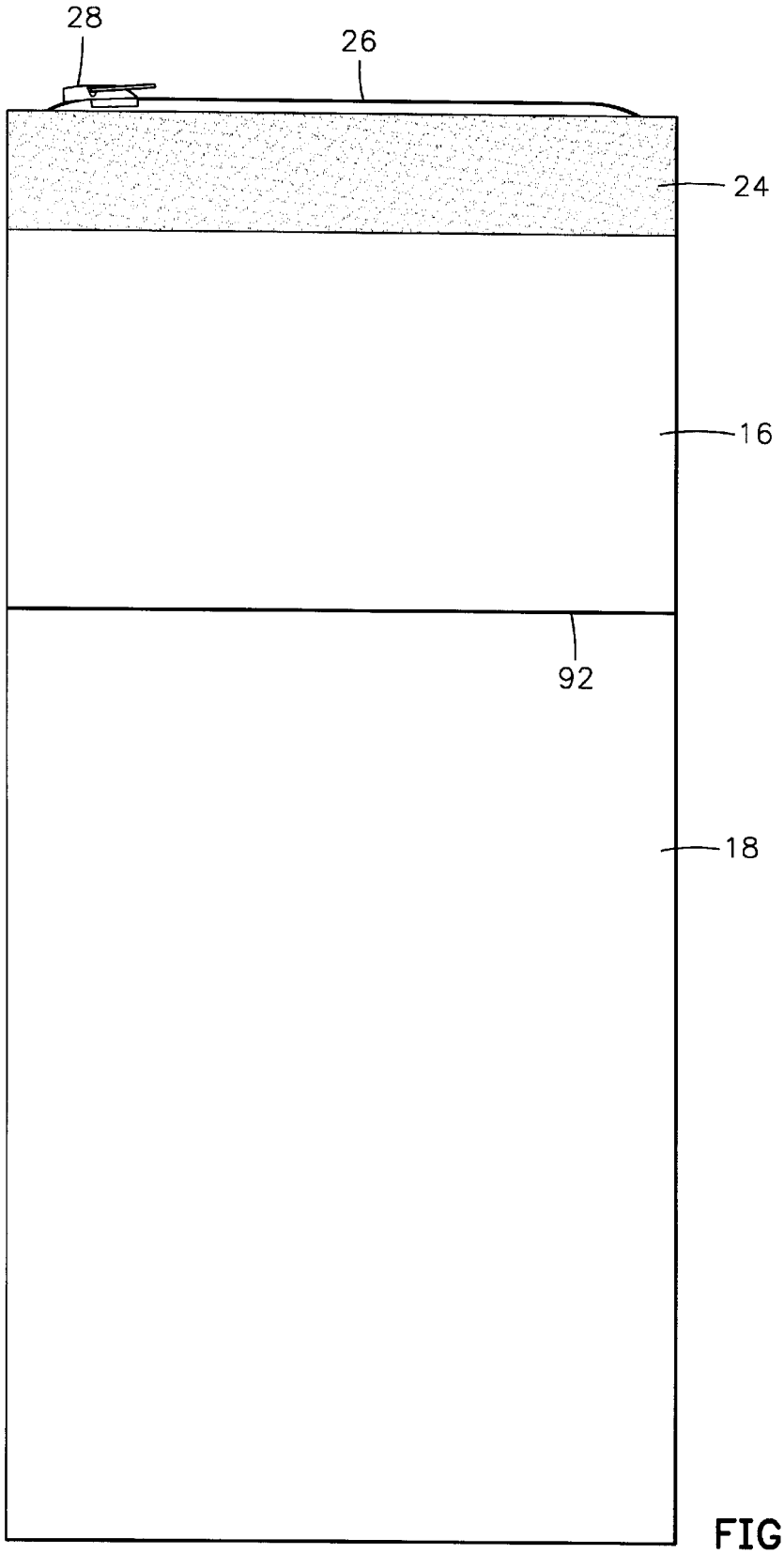
FIG. 6 is a back elevation view of the outside of the case with the case open.
Figure 7:
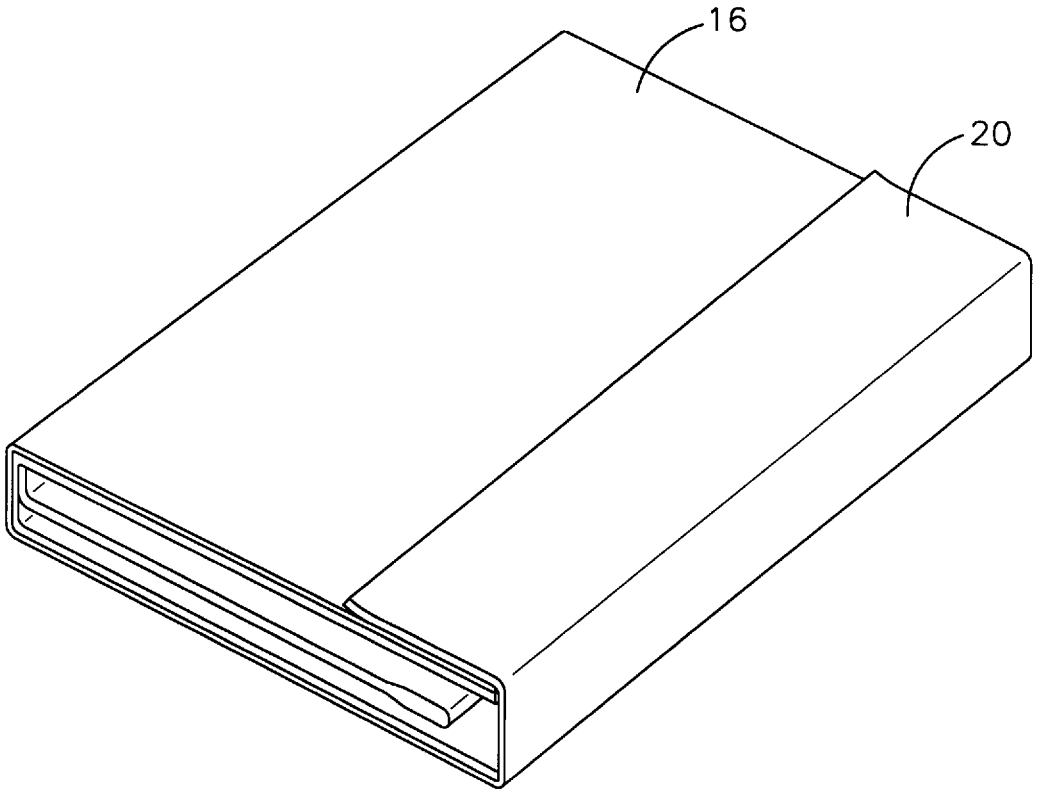
FIG. 7 is a perspective view showing the case closed from the front and above.

The front panel is primarily a cover and closure that hangs down as seen in FIGS. 5 and 6 to provide access to the interior thereof. It extends from the bottom edge 92 of back panel 16 and wraps over and encloses the entire interior of the organizing case and secures it closed as shown in FIG. 7. The organizer can be carried as a separate item, as shown in FIG. 7. It may also be provided with a separate cover (not shown) to dress it up for certain occasions. The cover could be a simple fabric purse like article having a size just sufficient to cover the organizer and have a zipper opening. It may also be of a thin light-weight material and can be carried in the organizer until ready for use.

While I have illustrated and described my invention by means of specific embodiments, it is to be understood that numerous changes and modifications may be made therein without departing from the spirit and the scope of the invention as shown in the appended claims.

I claim:

1. An organizing case for articles to be carried in a purse, comprising:

a primary panel of pliable material, said panel being of a generally rectangular configuration having an inner face and an outer face and foldable along a selected line transverse of the primary panel forming a front panel and a back panel defining a primary receptacle;

said back panel having an inner face, a plurality of straps and loops on said inner face for mounting a plurality of articles;

a pocket assembly inside said primary receptacle, said pocket comprising a back pocket panel and a front pocket panel secured together along a bottom and side edges forming a receptacle; and an inner mounting panel pivotally mounted to said primary panel and having a opposite faces, a mirror mounted on one of said faces, and a plurality of attachment means for detachably mounting a plurality of selected personal items on each of said faces.

2. The organizing case of claim 1 wherein said pocket assembly is embodied in said back panel.

3. The organizing case of claim 1 wherein said pocket assembly is pivotally mounted substantially on said selected line.

4. The organizing case of claim 1 wherein said primary panel includes a closure panel on one end thereof.

5. The organizing case of claim 4 wherein said closure panel detachably secures to the other end of said back panel by means of hook and loop fastening means.

6. The organizing case of claim 5 wherein said plurality of attachment means on one face of said inner mounting panel comprises a pair of elastic straps secured along opposite side edges of said one face, each strap forming a plurality of loops.

7. The organizing case of claim 6 wherein said plurality of attachment means on the other face of said inner mounting panel comprises a pair of elastic straps secured along opposite side edges of said mirror, each strap forming a loop.

8. The organizing case of claim 7 wherein said plurality of straps and loops on said inner face of said back panel having an inner face comprises a pair of straps extending transverse and a pair of straps extending longitudinally.

9. The organizing case of claim 8 wherein said inner mounting panel has a top face and a bottom face and said mirror mounted on said bottom face.

10. The organizing case of claim 9 wherein said back panel includes stiffening means and said pocket assembly is incorporated in said back panel.

11. The organizing case of claim 1 wherein said plurality of straps and loops on said inner face of said back panel comprises a pair of straps extending transverse and a pair of straps extending longitudinally.

12. The organizing case of claim 11 wherein said plurality of attachment means on one face of said inner mounting panel comprises a pair of elastic straps secured along opposite side edges of said one face, each strap forming a plurality of loops.

13. The organizing case of claim 12 wherein said plurality of attachment means on the other face of said inner mounting panel comprises a pair of elastic straps secured along opposite side edges of said of said mirror, each strap forming a loop.

14. The organizing case of claim 12 wherein said front panel comprises a cover panel for covering said a front face and said attachment means on the other face.

15. The organizing case of claim 1 wherein said primary panel includes a closure panel on one end thereof, one of hook and loop fastening means on said closure panel, and the other of hook and loop fastening means on the other end of said back panel for detachably securing said primary receptacle closed.

16. An organizing case to be carried in a purse for organizing articles, comprising:

a generally rectangular primary panel of pliable material, said panel having an inner face and an outer face and foldable along a selected transverse line transverse forming a front panel and a back panel defining a primary receptacle;

means for stiffening said back panel;

a first pocket assembly attached to said back panel;

said back panel having an inner face, a plurality of straps and loops on said inner face for mounting a plurality of articles;

a second pocket assembly inside said primary receptacle, said pocket assembly comprising a back pocket panel and a front pocket panel secured together along a bottom and side edges forming a receptacle; and an inner mounting panel pivotally mounted to said primary panel and having opposite faces, a mirror mounted on one of said faces, and a plurality of attachment means for detachably mounting a plurality of selected personal items on each of said faces.

17. The organizing case of claim 16 wherein said plurality of attachment means on one face of said inner mounting panel comprises a pair of elastic straps secured along opposite side edges of said one face, each strap forming a plurality of loops.

18. The organizing case of claim 16 wherein said primary panel includes a closure panel on one end thereof, one of hook and loop fastening means on said closure panel, and the other of hook and loop fastening means on the other end of said back panel for detachably securing said primary receptacle closed.

19. The organizing case of claim 18 wherein said plurality of attachment means on the other face of said inner mounting panel comprises a pair of elastic straps secured along opposite side edges of said mirror, each strap forming a loop.

20. An organizing case to be carried in a purse for organizing articles, comprising:

a generally rectangular primary panel of pliable material, said panel having an inner face and an outer face and foldable along a selected transverse line transverse forming a front panel and a back panel defining a primary receptacle, a closure panel on one end of said primary panel, said closure panel detachably secures to the other end of said back panel by means of hook and loop fastening means;

means for stiffening said back panel;

a first pocket assembly attached to said back panel and having an opening with a closure for the opening;

said back panel having an inner face, a plurality of straps forming loops on said inner face for mounting a plurality of articles;

a second pocket assembly inside said primary receptacle, said pocket assembly comprising a back pocket panel and a front pocket panel secured together along a bottom and side edges forming a receptacle, an opening along one edge, and a closure for said opening, said pocket assembly attached to said primary panel substantially along said line; and an inner mounting panel pivotally mounted to said primary panel and having opposite faces, a mirror mounted on one of said faces, and a plurality of attachment means along opposite sides of said mirror on said one face for detachably mounting a plurality of selected personal items.

* * * * *